US005303919A

United States Patent [19]

Takemoto et al.

[11] Patent Number: 5,303,919

[45] Date of Patent: Apr. 19, 1994

[54] SLOT MACHINE

[75] Inventors: Takatoshi Takemoto; Kazunari Kawashima, both of Tokyo, Japan

[73] Assignee: Kabushiki Kaisha Ace Denken, Tokyo, Japan

[21] Appl. No.: 910,122

[22] PCT Filed: Oct. 4, 1991

[86] PCT No.: PCT/JP91/01357

§ 371 Date: Jun. 16, 1992

§ 102(e) Date: Jun. 16, 1992

[87] PCT Pub. No.: WO92/09341

PCT Pub. Date: Jun. 11, 1982

[30] Foreign Application Priority Data

Nov. 29, 1990 [JP] Japan ..... 2-333223

[51] Int. Cl.[5] ..... G07F 17/34

[52] U.S. Cl. ..... 273/143 R

[58] Field of Search ..... 273/143 R, 138 A

[56] References Cited

U.S. PATENT DOCUMENTS 3,819,186 6/1974 Hinterstocker ..... 273/138 A
4,991,848 2/1991 Greenwood et al. ..... 273/138 A
5,113,990 5/1992 Gabrius et al. ..... 273/138 A
5,135,224 8/1992 Yamamoto et al. ..... 273/143 R

FOREIGN PATENT DOCUMENTS 3882636 11/1990 Fed. Rep. of Germany .
63-148972 9/1982 Japan .
63-77480 4/1988 Japan .
63-34753 7/1988 Japan .
2-46946 12/1990 Japan .
2158667A 11/1985 United Kingdom .
2170938 8/1986 United Kingdom ..... 273/143 R

OTHER PUBLICATIONS

The New York Times article "Hardware Makers Cash In On America's Betting Mania" by Kathleen Berry, Sep. 16, 1990.

*Primary Examiner*—Benjamin H. Layno
*Attorney, Agent, or Firm*—Lowe, Price, LeBlanc & Becker

[57] ABSTRACT

In a slot machine wherein a plurality of indications of patterns are changed by inserting a game medium into a slot and manipulating a game initiation switch, and the respective indications are stopped at stop timings selected by manipulating a stop switch; a slot machine comprising a handle which includes the game initiation switch and the stop switch.

25 Claims, 3 Drawing Sheets

SLOT MACHINE

DESCRIPTION

1. Technical Field of the Invention

The present invention relates to a slot machine wherein a game medium is inserted into a slot and wherein the changing patterns of pattern indication means are stopped by manipulating stop switches.

2. Background of the Prior Art

A conventional slot machine of the specified type is such that, after a game medium such as a gaming medal or coin has been inserted into a slot, a game initiation lever is manipulated to rotate three drums bearing the indications of pictures. Push-button stop switches mounted on the body of the slot machine are successively depressed to stop the rotations of the drums, and a predetermined number of game media are awarded as a prize in accordance with the combination of the stopped indications (refer to the official gazette of Japanese Utility Model Registration Application Laid-open No. 130590/1979).

The prior art, however, has the problem that, since means for stopping the rotations of the drums is the system of depressing the stop switches aligned on the body of the slot machine, the stopping operation holds little interest, so game players become tired of the slot machine game easily.

The present invention has been made in order to solve the above problem, has for its object to provide a slot machine which can increase the interest in a game owing to an interesting method of operation.

DISCLOSURE OF THE INVENTION

To the accomplishment of such an object, according to the present invention, there is provided a slot machine wherein a plurality of patterns are changed by inserting a game medium into a slot and manipulating a game initiation switch, and the respective patterns are stopped at stop timings selected by manipulating a stop switch. The slot machine is characterized by comprising a handle which includes the game initiation switch and the stop switch.

Such a slot machine may well be so constructed that the game medium includes at least two sorts consisting of a minimum medium unit, and a multiple medium unit which has a value corresponding to a plurality of such minimum medium units. Also, identification devices are comprised for the game medium units inserted into the slot, wherein games which conform to, at least, the values of the game medium units identified by the identification devices can be played.

Further, according to the present invention, there is provided a slot machine wherein indications of a plurality of pattern indication means are changed by inserting a game medium into a slot and manipulating a game initiation switch, and the changes of the respective indications are stopped at stop timings selected by manipulating the stop switches. This slot machine is characterized by comprising identification devices for units of the game medium inserted into the slot, sum value storage means for summing value numbers of the game medium units identified by the identification devices, and for storing the sum value number and means for setting the value number of the game medium unit to be spent on one game. The machine also comprises a stake selection value display portion which displays the value number set by the setting means, value subtraction means for subtracting the value number set by the setting means, from the value number stored in the sum value storage means, in response to the manipulation of the game initiation switch and start means for bringing the game initiation switch into a manipulatable state on condition that the game medium unit has been identified by the identification device and that the value number has been set by the setting means. The machine further comprises reward judgment means for judging whether or not a combination of the respective indications after the stop of the changes is a prize awarding combination, prize value storage means for storing value numbers of prizes beforehand, prize value selection means for selecting any of the value numbers of the prizes stored in the prize value storage means, in conformity with the prize awarding combination judged by the reward judgment means, a prize value display portion which displays the value number of the prize selected by the prize value selection means, value addition means for adding the value number of the prize selected by the prize value selection means, to the value number stored in the sum value storage means, a value total display portion which displays the value number stored in the sum value storage means, the value number obtained by the subtraction of the value subtraction means, and the value number obtained by the addition of the addition means and a handle which includes the game initiation switch, the stop switches and the setting means.

The slot machine can be constructed comprising a structure in which the handle includes a rockable grip, and in which the stop switch is manipulated by depressing a button switch mounted on the grip after the pattern indication means to have the change of its indications stopped has been selected by rocking said grip in a predetermined direction.

Also, the slot machine can be constructed comprising a structure in which the handle includes a turnable grip, and in which the stop switch is manipulated by depressing a button switch mounted on the grip after the pattern indication means to have the change of its indications stopped has been selected by rotating the grip in a predetermined direction.

The patterns of the plurality of pattern indication means are changed by manipulating the game initiation switch mounted on the handle, and the patterns of the indications are stopped in accordance with the corresponding stop timings by manipulating the stop switch mounted on the handle. The handle can be held with one hand or both hands, and is easy to manipulate.

In the case where the minimum medium unit and the multiple medium unit are employed as the game medium units, they are properly used as such and are inserted into the slot. The start means permits a game player to play, at least, games corresponding to the number of the game media identified by the identification devices.

In the case where the sum value storage means, etc. are comprised, the minimum medium unit and the multiple medium unit are properly used as the game medium units and are inserted into the slot, and the value numbers of the game media identified by the identification devices are summed up by the sum value storage means so as to display the sum value number on the value total display portion. The game player manipulates the stake selection switch of the handle, whereby the value number of the game medium unit to be spent on one game is set by the value setting means, and he/she manipulates the game initiation switch rendered manipulatable by the start means. The value number set by the value setting means is displayed on the stake selection value display portion, and it is subtracted from the value number stored in the sum value storage means, by the value subtraction means in response to the manipulation of the game initiation switch. The value number obtained by the subtraction is displayed on the value total display portion.

The indications of the plurality of pattern indication means are changed simultaneously with the manipulation of the game initiation switch of the handle, and the changes of the indications of the respective means are stopped at the stop timings selected by the manipulations of the stop switches of the handle. When the combination of the indications which have stopped changing is judged to be a prize awarding one by the reward judgment means, any of the prize value numbers stored in the prize value storage means is selected by the prize value selection means in accordance with the prize awarding combination, and it is displayed on the prize value display portion. The selected prize value number is added to the value number stored in the sum value storage means, by the value addition means, and the value number obtained by the addition is displayed on the value total display portion.

In the case where the pattern indication means to have its indications stopped is selected by rocking or turning the grip of the handle in the predetermined direction, the stopping operation involves a movement and can increase interest.

DETAILED DESCRIPTION OF THE PREFERRED EMBODIMENTS

Now, the first embodiment of the present invention will be described in conjunction with the drawings.

FIGS. 1~4 show the first embodiment of the present invention.

Figure 1:
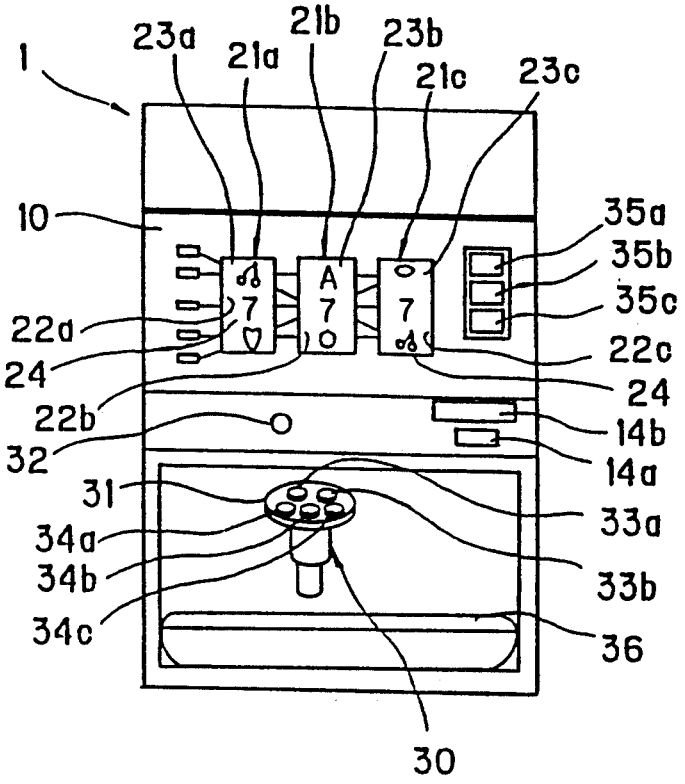
FIG. 1 is a front view of a slot machine which is the first embodiment of the present invention.
Figure 2:
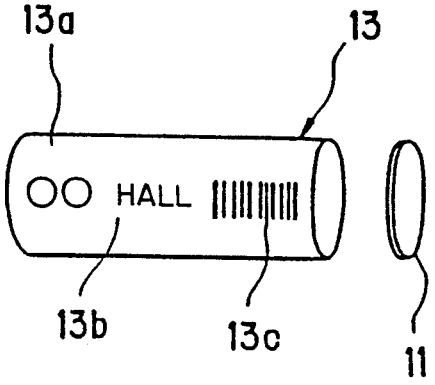
FIG. 2 is a perspective view of a gaming medal and a gaming medal bundle which are game media.

As shown in FIG. 1, the front of the body 10 of the slot machine 1 is provided with two slots for game media. The game media employed are of two sorts consisting of a gaming medal 11 which is a minimum medium unit, and a gaming medal bundle 13 which is a multiple medium unit. The gaming medal bundle 13 is a bundle which is formed of fifty gaming medals 11 wrapped in an envelope 13*a*, so that it has a value corresponding to the fifty gaming medals 11. As shown in FIG. 2, the name of a game hall 13*b* and a bar code portion for identification 13*c* are printed on the envelope 13*a*. Such marks to be affixed to the envelope 13*a* should desirably be ones from which it is readily discerned that the game medium is the regular medium for use in the game hall, and which cannot be easily counterfeited.

The lower slot is a single-medal slot 14*a* for inserting the gaming medals 11 one by one thereinto, while the upper slot is a bundle slot 14*b* for inserting the gaming medal bundle 13 directly thereinto.

The front of the body 10 is equipped with three pattern indication means 21*a*, 21*b* and 21*c*. The pattern indication means 21*a*, 21*b* and 21*c* include three indication windows 22*a*, 22*b* and 22*c* in lateral alignment, which are formed in the front of the body 10, three drums 23*a*, 23*b* and 23*c* which are disposed within the body 10 in correspondence with the indication windows, and drive means (not shown) capable of respectively rotating the drums independently of one another. A large number of indications 24 formed of patterns such as numerals and symbols are depicted on the outer peripheries of the drums 23*a*, 23*b* and 23*c*. These drums 23*a*, 23*b* and 23*c* are respectively arranged inside the indication windows 22*a*, 22*b* and 22*c* so that three of the indications 24 may be always seen through each of the indication windows.

Figure 4:
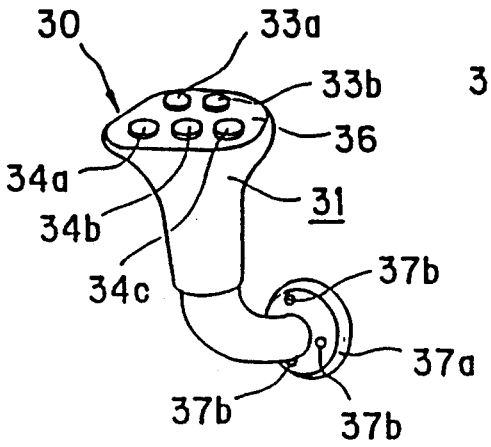
FIG. 4 is a perspective view of a handle.

In addition, a clear switch 32 is mounted on the front of the body 10. The clear switch 32 is a switch for paying out payable gaming medals 11. Also, a handle 30 is mounted on the front of the body 10 in a manner to protrude toward the front. As shown in FIG. 4, the handle 30 includes a game initiation switch 31 which is made of a grip being rockable toward the front, and it has its base part 37*a* fixed to the body 10 by threaded screws 37*b*. See FIGS. 4–8.

Besides, the handle 30 includes two stake selection switches 33*a* and 33*b*, and stop switches 34*a*, 34*b* and 34*c* at the upper end part 36 of the game initiation switch 31. The game initiation switch 31 can be held with one hand. It is a lever switch which is manipulated by pulling it toward the front after the insertion of the gaming medal 11 or gaming medal bundle 13 into the corresponding slot 14*a* or 14*b*, whereby the drive means are actuated to rotate the drums 23*a*, 23*b* and 23*c* and to change the indications 24 of the pattern indication means 21*a*, 21*b* and 21*c* seen through the indication windows 22*a*, 22*b* and 22*c*, respectively.

The stake selection switch 33*a* is a push-button switch with which "one" is selected as the value number of the gaming medal(s) 11 to be spent on one game, and with which "two" is selected when it is depressed twice. The stake selection switch 33*b* is a push-button switch with which "three" is selected as the value number of the gaming medals 11 to be spent on one game. Depending upon which of the stake selection switches 33*a* and 33*b* is selected, the number of rewarding combinations differs between the cases where the number of gaming medal(s) to be spent on one game is "one" or "two" and where it is "three".

The stop switches 34*a*, 34*b* and 34*c* correspond to the pattern indication means 21*a*, 21*b* and 21*c*, respectively. They are push-button switches which control the drive means so as to stop the rotations of the corresponding drums 23*a*, 23*b* and 23*c* at stop timings selected by manipulating them, whereby the changes of the indications 24 seen through the indication windows 22*a*, 22*b* and 22*c* are stopped, respectively.

Further, the front of the body 10 is furnished with three digital display portions in vertical alignment. The upper digital display portion is a prize value display portion 35*a*, which displays the premium number of gaming medals 11 as the value number of a prize. The middle digital display portion is a value total display portion 35*b*, which displays the total number of all payable gaming medals 11 possessed by the game player of the slot machine. The lower digital display portion is a stake selection value display portion 35*c*, which displays the number of gaming medals 11 selected with the stake selection switch 33*a* or 33*b*.

A pay-out saucer 36 is provided at the lower part of the front of the body 10. The pay-out saucer 36 serves to pay the gaming medals 11 out of the interior of the body 10 upon manipulation of the clear switch 32.

Figure 3:
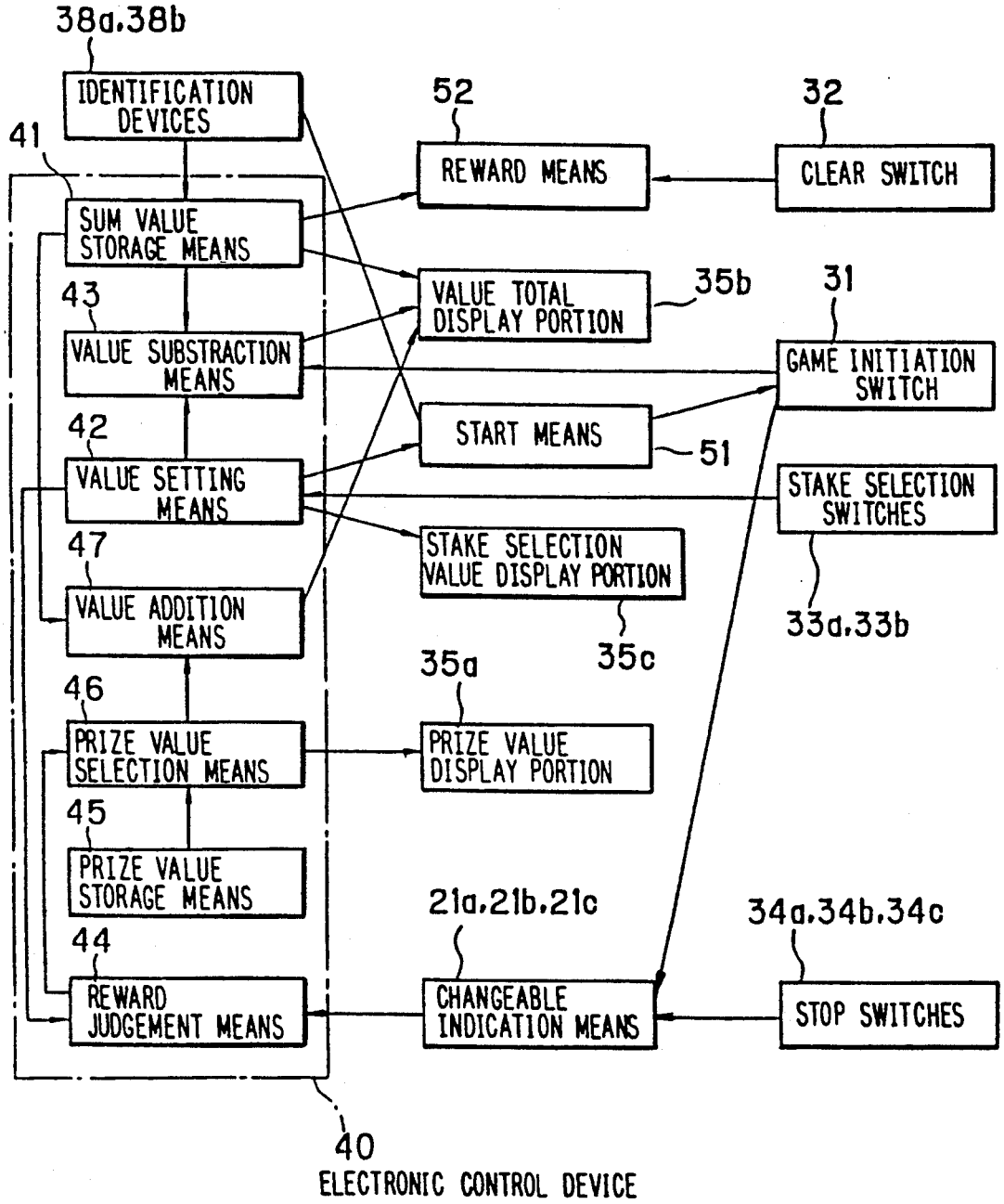
FIG. 3 is a block diagram showing the functions of the slot machine.

As shown by a block diagram in FIG. 3, the body 10 is internally furnished with identification devices 38*a* and 38*b*, an electronic control device 40, start means 51, and reward means 52. The identification device 38*a* examines the genuineness of the gaming medal 11 inserted into the slot 14*a* and identifies the sort thereof, while the identification device 38*b* examines the genuineness of the gaming medal bundle 13 inserted into the slot 14*b* and identifies the sort thereof. The identification device 38*b* identifies the gaming medal bundle 13 by automatically reading the bar code portion 13*c*.

The electronic control device 40 includes sum value storage means 41, value setting means 42, value subtraction means 43, reward judgment means 44, prize value storage means 45, prize value selection means 46 and value addition means 47.

The sum value storage means 41 is means for summing up the number in single-medal unit, of the gaming medals 11 or gaming medal bundle 13 identified by the corresponding identification device 38*a* or 38*b*, and for storing the sum medal number therein. The value setting means 42 is means for setting the value number of the gaming medals 11 to be spent on one game, to "one" in response to the manipulation of the stake selection switch 33*a*, and for setting the value number of the gaming medals 11 to be spent on one game, to "three" in response to the manipulation of the stake selection switch 33*b*. In a case where the number of gaming medal(s) to be set is larger than the number of gaming medal(s) stored in the sum value storage means 41, the value setting means 42 sets the latter number. The stake selection value display portion 35*c* displays the value number set by the value setting means 42, in terms of the number of gaming medal(s).

The value subtraction means 43 is means responsive to the manipulation of the game initiation switch 31, for subtracting the number of gaming medal(s) which is the value number set by the value setting means 42, from the number of gaming medal(s) which is the value number stored in the sum value storage means 41.

The start means 51 is switching means for bringing the game initiation switch 31 into a manipulatable state on condition that the gaming medal(s) 11 or gaming medal bundle 13 has been identified by the corresponding identification device 38*a* or 38*b* and that the number of gaming medal(s) has been set by the value setting means 42. The setting means 42 is capable of setting the number of gaming medal(s) to be spent on one game, repeatedly within the limits of the number of gaming medals stored in the sum value storage means 41. Even in the absence of any rewarding combination displayed, therefore, the start means 51 permits the game player to play games, at least, in the number of times corresponding to the value of the gaming medal(s) 11 or gaming medal bundle 13 identified by the identification device 38*a* or 38*b*.

The reward judgment means 44 is means for judging whether or not the combination of the indications 24 stopped changing by manipulating the stop switches 34*a*, 34*b* and 34*c* is any of preset rewarding combinations. In the case of selecting the stake selection switch 33*a*, the rewarding combinations include the combination in which the three indications, for example, "7's" respectively presented as the patterns at the middle stages of the indication windows 22*a*, 22*b* and 22*c* by the three pattern indication means 21*a*, 21*b* and 21*c* are laterally aligned in a straight line. Besides, when the stake selection switch 33*a* has been depressed twice so as to set "two" as the number of the gaming medals by the value setting means 42, the rewarding combinations include the combination in which the three indications at any of the upper stages, middle stages and lower stages of the respective indication windows 22*a*, 22*b* and 22*c* are laterally arrayed.

In the case of selecting the stake selection switch 33*b*, the rewarding combinations include the combination in which the three indications 24 are laterally arrayed at any of the upper stages, middle stages and lower stages of the respective indication windows 22*a*, 22*b* and 22*c*; the combination in which the three indications are diagonally arrayed at the lower stage of the left indica-tion window 22*a*, at the middle stage of the central indication window 22*b* and at the upper stage of the right indication window 22*c*; or the combination in which the three indications are obliquely arrayed at the upper stage of the left indication window 22*a*, at the middle stage of the central indication window 22*b* and at the lower stage of the right indication window 22*c*.

The prize value storage means 45 is means for storing the numbers of gaming medals of prizes beforehand. The prize value selection means 46 is means for selecting any of the number of gaming medal prizes as stored in the prize value storage means 45, in accordance with the rewarding combination judged by the reward judgment means. In a case where the stopped indications 24 are not in any predetermined rewarding combination, the prize value selection means 46 selects "zero" as the number of gaming medals. The prize value display portion 35*a* displays the number of gaming medals of the prize as selected by the prize value selection means 46.

The value addition means 47 is means for adding the number of the premium gaming medals selected by the prize value selection means 46, and for storing the result in the sum value storage means 41. The value total display portion 35*b* displays the number of gaming medals stored in the sum value storage means 41, the number of gaming medals obtained by the subtrac-tion of the value subtraction means 43, and the value number obtained by the addition of the value addition means 47.

The reward means 52 is means responsive to the manipulation of the clear switch 32, for awarding the prize in such a way that the gaming medals 11 or gaming medal bundles 13 corresponding to the number of the gaming medals stored in the sum value storage means 41 are paid out into the pay-out saucer 36.

The electronic control device 40 can be realized by appropriately employing a microcomputer capable of programing the functions of these means 41~47, or an equivalent thereto. When it is realized with the microcomputer by way of example, it is constructed having a central processing unit, a read-only memory, a random access memory, an interface, etc. The read-only memory stores therein the operating program of the central processing unit, while the random access memory stores therein preset display control signals as predetermined.

Next, the operation will be described.

The gaming medal 11 and gaming medal bundle 13 are properly used as the game media, and are respectively inserted into the single-medal slot 14*a* and bundle slot 14*b*. The gaming medal bundle 13 may be used either by inserting it into the bundle slot 14*b* directly without unpacking it, or by unpacking it into individual gaming medals and then inserting them into the single-medal slot 14*a* in the same manner as in the prior art. When the gaming medal 11 or gaming medal bundle 13 inserted has been judged genuine by the corresponding identification device 38*a* or 38*b*, it is accepted into the body, and when it has been judged not genuine, it is returned into the pay-out saucer 36. The game player may insert the returned game medium into the corresponding slot 14*a* or 14*b* again, or may ask the game parlor to exchange it for another. In the case of the gaming medal bundle 13, the game player may well tear the envelope 13*a* and take out the contained gaming medals 11 so as to use them one by one.

The sum number in single-medal units, of the gaming medals 11 or gaming medal bundle 13 identified by the identification device 38*a* or 38*b* is found by the sum value storage means 41, and it is displayed on the value total display portion 35*b*. Subsequently, the game initiation switch 31 serving also as the grip of the handle 30 is held with one hand, and the stake selection switch 33*a* or 33*b* of the handle 30 is manipulated by depressions, whereby the number of gaming medal(s) 11 to be spent on one game is set to any of "one" thru "three" inclusive by the value setting means 42. The handle 30 can be held with one hand, and is easy to manipulate. Further, the game initiation switch 31 rendered manipulatable by the start means 51 is manipulated by pulling it toward this side.

The start means 51 permits the game player to play the games, at least, while the number of gaming medal(s) 11 or the individual gaming medals of the bundle 13 identified by the identification device 38*a* or 38*b* is stored in the sum value storage means 41 or while the number of the gaming medal(s) inserted is stored in the value setting means 42.

The number of gaming medal(s) set by the value setting means 42 is displayed on the stake selection value display portion 35*c*, and it is subtracted from the number of gaming medal(s) stored in the sum value storage means 41, by the value subtraction means 47 in response to the lever manipulation of the game initiation switch 31. The number of gaming medal(s) resulting from the subtraction is displayed on the value total display portion 35*b*.

Simultaneously with the manipulation of the game initiation switch 31 of the handle 30, the drums 23*a*, 23*b* and 23*c* are rotated by the drive means, thereby changing the indications 24 seen through the respective indication windows 22*a*, 22*b* and 22*c* of the three changable indication means 21*a*, 21*b* and 21*c*. The patterns of the indications 24 of the pattern indication means 21*a*, 21*b* and 21*c* as seen through the indication windows 22*a*, 22*b* and 22*c* are respectively stopped at stop timings selected by depressing the stop switches 34*a*, 34*b* and 34*c* of the handle 30.

When the combination of the indications 24 after the stopping of the patterns has been judged to be any rewarding combination by the reward judgment means 44, the number of gaming medals of a prize stored in the prize value storage means 45 is selected by the prize value selection means 46 in accordance with the rewarding combination and is displayed on the prize value display portion 35*a*. Thus, the number of gaming medals awarded as the prize can be known.

When the number of the gaming medal(s) 11 to be spent on the next game has been set by depressing the stake selection switch 33*a* or 33*b* of the handle 30, the selected number of gaming medals of the prize is added to the number of gaming medals stored in the sum value storage means 41, by the value addition means 47, and the number of gaming medals resulting from the addition is displayed on the value total display portion 35*b*. At the same time, the number of gaming medals set by the value setting means 42 is displayed on the stake selection value display portion 35*c*, and the total number of gaming medals after the subtraction from the set number of the gaming medals is displayed on the value total display portion 35*b*.

In this manner, the games can be repeated until the display of the number of gaming medals on the value total display portion 35*b* disappears. Moreover, even when the game is proceeding with the number of gaming medals displayed on the value total display portion 35*b*, the gaming medal 11 or gaming medal bundle 13 may well be additionally inserted into the single-medal slot 14*a* or bundle slot 14*b*.

In a case where the game player accepts the prize, he/she depresses the clear switch 32. Then, the payable gaming medals 11 in the number displayed on the value total display portion 35*b* are delivered into the pay-out saucer 36 in the form of gaming medals 11 or gaming medal bundles 13. As a paying-out method, at the first step, the number of gaming medals displayed on the value total display portion 35*b* is divided by the number of gaming medals 11 contained in the gaming medal bundle 13, and that integral number of gaming medal bundles 13 which is equal to the quotient of the division are delivered. At the second step, that number of gaming medals 11 which is equal to the remainder of the division are delivered one by one from a hopper mounted inside the body. Thereafter, "0" (zero) is displayed as the number of gaming medals on the value total display portion 35*b*.

The game player carries the gaming medals 11 and gaming medal bundles 13 paid out, to the corner of the game hall where they are to be exchanged for prizes and where they are put into respective counters. Then, whether or not the gaming medals and gaming medal bundles are genuine is checked, and they are also counted so as to display the number counted in terms of the gaming medals 11. The method of counting the gaming medal bundles 13 as they are, can raise the speed of counting the gaming medals 40~50 times as compared with a case where the bundles are unpacked into the individual gaming medals to be counted.

As thus far described, when the game media in a predetermined quantity are inserted in beforehand, the games can be carried forward merely by manipulating the handle 30.

Figure 5:
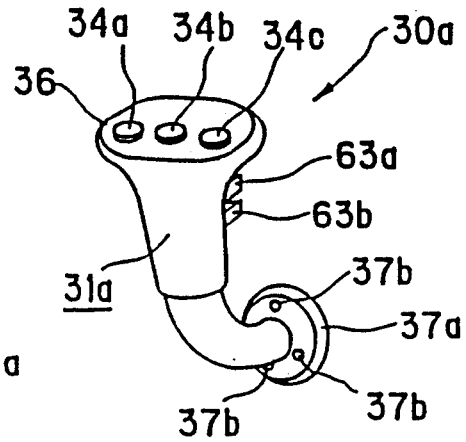
FIG. 5 is a perspective view of a handle in the second embodiment.

Now, the second embodiment of the present invention will be described. FIG. 5 shows the handle of a slot machine in the second embodiment of the present invention. Incidentally, constituents similar to those of the first embodiment have the same symbols assigned thereto and shall not be repeatedly explained.

As shown in FIG. 5, the handle 30*a* is furnished with two stake selection switches 63*a* and 63*b* at the rear part of a game initiation switch 31*a*. Each of the stake selection switches 63*a* and 63*b* can be depressed by the first finger or middle finger when the game initiation switch 31*a* is held with one hand, so that it is easy to manipulate.

Figure 6:
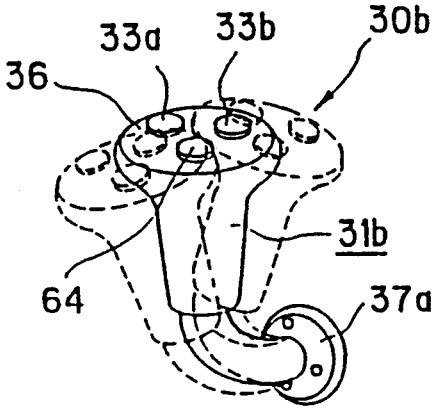
FIG. 6 is a perspective view of a handle in the third embodiment.

Now, the third embodiment of the present invention will be described. FIG. 6 shows the handle of a slot machine in the third embodiment of the present invention. Incidentally, constituents similar to those of the first embodiment have the same symbols assigned thereto and shall not be repeatedly explained.

As shown in FIG. 6, a game initiation switch 31*b* which is the grip of the handle 30*b* is rockable, not only toward the front, but also laterally as depicted by broken lines. The handle 30*b* is furnished with two stake selection switches 33*a* and 33*b* at the rear part of the game initiation switch 31*b*.

Stop switches have the following structure: When the change of the indications 24 of pattern indication means 21*a* among pattern indication means 21*a*, 21*b* and 21*c* is to be stopped, the game initiation switch 31*b* is rocked leftwards, thereby selecting the left pattern indication means 21*a*; when the change of the pattern indication means 21*b* is to be stopped, the central pattern indication means 21*b* is selected at a neutral position depicted by solid lines; and when the change of the pattern indi7 cation means 21*c* is to be stopped, the game initiation switch is rocked rightwards, thereby selecting the right pattern indication means 21*c*. After the respective selecting operations, a button switch 64 mounted on the upper end part 36 of the game initiation switch 31*b* is depressed.

In this embodiment, the stopping operation involves motion and can increase interest.

Incidentally, in order to easily acknowledge which of the stops of the pattern indication means 21*a*, 21*b* and 21*c* has been selected, lamps may well be correspondingly disposed near the respective pattern indication means 21*a*, 21*b* and 21*c* so as to light up the associated lamps in accordance with the directions of rocking the handle 30*b*.

Figure 7:
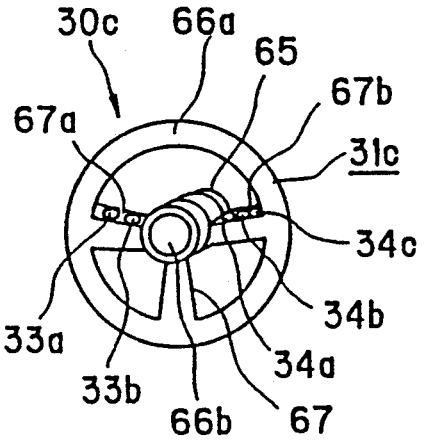
FIG. 7 is a perspective view of a handle in the fourth embodiment.

Now, the fourth embodiment of the present invention will be described. FIG. 7 shows the handle of a slot machine in the fourth embodiment of the present invention. Incidentally, constituents similar to those of the first embodiment have the same symbols assigned thereto and shall not be repeatedly explained.

As shown in FIG. 7, the handle 30*c* includes a game initiation switch 31*c* having a ring-shaped grip 66*a*, and it has its base part 65 fixed to the body 10 of the slot machine. The game initiation switch 31*c* has a shaft 66*b* which is extended from the base part 65, and three connection parts 67 which are extended radially from the shaft 66*b* to the grip 66*a*. Two stake selection switches 33*a* and 33*b* are mounted on the upper end part 67*a* of the left connection part 67. Besides, stop switches 34*a*, 34*b* and 34*c* are mounted on the upper end part 67*b* of the right connection part 67.

In this embodiment, the handle 30*c* can be held with both hands and is easy to manipulate.

Figure 8:
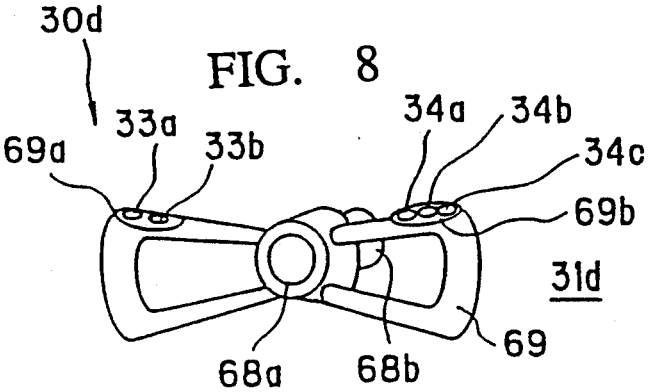
FIG. 8 is a perspective view of a handle in the fifth embodiment.

Now, the fifth embodiment of the present invention will be described. FIG. 8 shows the handle of a slot machine in the fifth embodiment of the present invention. Incidentally, constituents similar to those of the first embodiment have the same symbols assigned thereto and shall not be repeatedly explained.

As shown in FIG. 8, the handle 30*d* includes a game initiation switch 31*d* which has grips 69 protruding bilaterally from a shaft 68*a*, and it has its base part 68*b* fixed to the body 10 of the slot machine. Two stake selection switches 33*a* and 33*b* are mounted on the upper end part 69*a* of the left grip 69. Besides, stop switches 34*a*, 34*b* and 34*c* are mounted on the upper end part 69*b* of the right grip 69.

Meanwhile, the first embodiment may well have such a structure that the handle includes a turnable grip, and that the stop switches are replaced with a button switch which is mounted on the grip and which is depressed after the pattern indication means to have the changes of the indications stopped are selected by rotating the grip in predetermined directions.

Besides, in each of the embodiments, the minimum medium unit of the game media may well be composed of gaming coins, not the gaming medals. Also, the number of gaming medals of the gaming medal bundle is not restricted to fifty, but it may well be any number such as forty or ten. Also, instead of the gaming medal bundle, the multiple medium unit may well be composed of gaming medals which differ from those of the minimum medium unit in thickness or diameter, gaming coins, or the like.

Further, in each of the embodiments, the multiple medium unit is not restricted to the single sort, but it may well include a plurality of sorts having values different from each other, for example, a sort equivalent to fifty gaming medals and a sort equivalent to one hundred gaming medals.

Still further, in each of the embodiments, the amount of money corresponding to one minimum medium unit may well be employed as the value number of the game medium (media), apart from the number of the gaming medal(s) forming the minimum medium unit.

Yet further, in each of the embodiments, the three pattern indication means may well substitute the rotary drums by electric indication means such as LED's, liquid-crystal displays, or the like.

Moreover, in each of the embodiments, the slots which are separate for the minimum medium unit and the multiple medium unit may well be replaced with one common slot.

In addition, in each of the embodiments, the game initiation switch is not restricted to the lever type, but it may well be a push-button type.

Yet in addition, in each of the embodiments, unlike the foregoing aspect in which the pattern indication means have their indications stopped changing at the stop timings selected by the manipulations of the stop switches, the changes may well be stopped automati7 cally after predetermined time periods.

Also, in each of the embodiments, unlike the foregoing aspect in which, when the stake selection switch has been manipulated, the number of premium gaming medals displayed on the prize value display portion is added to the total number of gaming medals displayed on the value total display portion, followed by the display of the resulting sum; the addition to be followed by the display may well be performed when the game initiation switch has been manipulated.

Industrial Applicability

Since a slot machine according to the present invention is manipulated with a game initiation switch and stop switches mounted on a handle, the operation thereof is interesting which can increase interest in the games.

We claim:

1. In a slot machine, wherein a plurality of indications of patterns are changed by a user inserting a game medium unit into a slot and manipulating a game initiation switch to initiate drive means causing movement of the patterns and wherein the respective indications are stopped at stop timings selected by manipulating a stop switch to stop the drive means and the related movement of patterns, an improvement comprising:

an operating means comprising a handle which includes said game initiation switch and said stop switch.

2. The slot machine according to claim 1, wherein:

said game medium unit includes at least a minimum medium unit and a multiple medium unit, wherein each multiple medium unit comprises a plurality of minimum medium units and has a value corresponding to a value of said plurality of the mini7 mum medium units; and the slot machine further comprises identification means for identifying game medium units inserted into said slot and for enabling a play of the game in correspondence with a value of the identified game medium units, whereby games which correspond to at least the values of said game medium units, as identified by said identification devices, can be played.

3. The slot machine according to claim 2, wherein:

said multiple medium unit is formed as a bundle of a predetermined number of said minimum medium units.

4. The slot machine according to claim 3, wherein:

said bundle comprises a wrapping that is removable to allow the user access to said minimum medium units of said bundle.

5. The slot machine according to claim 4, further comprising:

means for separately receiving said minimum medium units and said multiple medium units and for determining corresponding values of said received mini7 mum and multiple medium units respectively.

6. The slot machine according to claim 5, further comprising:

means for providing a predetermined prize corresponding to an outcome of an operation of said slot machine, said prize comprising one or more of each of said minimum and multiple medium units.

7. The slot machine according to claim 3, wherein:

said bundle is provided with a bar code related to a corresponding value of said minimum medium units contained therein.

8. The slot machine according to claim 1, further comprising:

a structure in which said handle includes a rockable grip, wherein said stop switch is manipulated by depressing a button switch mounted on said grip after the pattern indication means to have the change of indications stopped has been selected by rocking said grip in a predetermined direction.

9. The slot machine according to claim 1, further comprising:

a structure in which said handle includes a tunable grip, wherein said stop switch is manipulated by depressing a button switch mounted on said grip after the pattern indication means to have the change of indications stopped has been selected by rotating said grip in a predetermined direction.

10. The slot machine according to claim 1, wherein:

said handle is formed and supported to a front of said slot machine and is rockable toward said front, said handle having an upper portion graspable by the user and provided with a plurality of switches operable by the user to control said pattern indications.

11. The slot machine according to claim 10, wherein:

said switches include switches operable to control a value amount to be spent by the user for a game.

12. The slot machine according to claim 11, wherein:

said handle cooperates with said game initiation switch such that a rocking motion of said lever actuates said game initiation.

13. In a slot machine wherein indications of a plurality of pattern indication means are changed by a user inserting game medium units each having a respective value number into a slot and manipulating a game initiation switch to initiate drive means causing movement of the patterns, and wherein the changes of the respective indications are stopped at stop timings selected by a user manipulating stop switches to stop the drive means and the movement of corresponding patterns, and improvement comprising:

identification devices for identifying respective value numbers of said game medium units inserted into said slot;

sum value storage means for summing the value numbers of a plurality of said inserted game medium units identified by said identification devices and for storing a corresponding sum value number;

means for setting a set value number of said game medium units to be spent on one game;

stake selection value display means for displaying said set value number;

value subtraction means for subtracting said set value number from said sum value number stored in said sum value storage means, in response to a manipulation of said game initiation switch;

start means for putting said game initiation switch into an operable state on condition that said game medium units have been identified by said identifi7 cation device and that said set value number has been set by said setting means;

reward judgment means for judging whether or not a combination of said respective pattern indications after the stop of said pattern indication changes corresponds to a selected prize awarding pattern combination and for determining a corresponding prize;

prize value storage means for storing respective predetermined prize value numbers of selected prizes;

prize value selection means for selecting any of said prize value numbers stored in said prize value storage means in conformity with said selected prize awarding combination judged by said reward judgment means;

a prize value display portion which displays said prize value number of said prize selected by said prize value selection means;

value addition means for adding the prize value number of said prize selected by said prize value selection means to said sum value number stored in said sum value storage means;

a value numbers display portion which displays said sum value number stored in said sum value storage means, the value number obtained by the subtraction of said value subtraction means, and the value number obtained by the addition of said addition means; and a handle which includes said game initiation switch, said stop switches and said setting means.

14. The slot machine according to claim 3, wherein: said multiple medium unit is formed as a bundle of a predetermined number of said minimum medium units.

15. The slot machine according to claim 14, wherein: said bundle comprises a wrapping that is removable to allow the user access to said minimum medium units of said bundle.

16. The slot machine according to claim 15, further comprising:

means for separately receiving said minimum medium units and said multiple medium units and for determining corresponding values of said received minimum and multiple medium units respectively.

17. The slot machine according to claim 16, further comprising:

means for providing a predetermined prize corresponding to an outcome of an operation of said slot machine, said prize comprising one or more of each of said minimum and multiple medium units.

18. The slot machine according to claim 13, wherein: said handle is formed and supported to a front of said slot machine and is rockable toward said front, said handle having an upper portion graspable by the user and provided with a plurality of switches operable by the user to control said pattern indications.

19. The slot machine according to claim 18, wherein: said switches include switches operable to control a value amount to be spent by the user for a game.

20. The slot machine according to claim 19, wherein: said handle cooperates with said game initiation switch such that a rocking motion of said lever actuates said game initiation.

21. The slot machine according to claim 13, wherein: said handle comprises a game initiation switch and two stake selection switches, said handle being rockable to a position wherein said game initiation switch is actuated, said stake selection switches being located at a rear portion of said handle to be depressed by one of the first and middle fingers of the user's hand grasping said handle.

22. The slot machine according to claim 13, wherein: said handle is supported to a front side of the slot machine in such a manner as to be rockable front-to-back and also side-to-side, said handle cooperating with said game initiation switch and actuating the game initiation switch upon being rocked front-to-back, said handle also comprising two stake selection switches, at a rear portion of said handle.

23. The slot machine according to claim 22, wherein: said handle comprises a button switch connected such that actuation of the button switch while said handle is in a leftward position, a neutral position and a rightward position causes a left, a central and a right pattern changing means, respectively, to be actuated to stop a corresponding left, central or right pattern indication.

24. The slot machine according to claim 13, wherein: said handle comprises a three-spoked wheel, and is provided with two stake selection switches mounted on an upper part of a first of said spokes and three pattern indication stop switches on an upper portion of a second of said spokes.

25. The slot machine according to claim 13, wherein: said handle comprises bilaterally protruding left and right grips and a base part fixed to said slot machine, with two stake-selection switches provided on an upper part of said left grip and three pattern stop switches provided on an upper part of said left grip.

* * * * *